US005720677A

United States Patent [19]

Rudduck

[11] Patent Number: 5,720,677

[45] Date of Patent: Feb. 24, 1998

[54] ADJUSTABLE HEIGHT GOLF TEE

[76] Inventor: Dickory Rudduck, 81 Castle Circuit, Seaforth, New South Wales 2093, Australia

[21] Appl. No.: 578,512

[22] PCT Filed: Jun. 28, 1994

[86] PCT No.: PCT/AU94/00361

§ 371 Date: Jul. 22, 1996

§ 102(e) Date: Jul. 22, 1996

[87] PCT Pub. No.: WO95/00213

PCT Pub. Date: Jan. 5, 1995

[30] Foreign Application Priority Data

Jun. 28, 1993 [AU] Australia ..... PL9662
Dec. 24, 1993 [AU] Australia ..... PM3130

[51] Int. Cl.[6] ..... A63B 57/00

[52] U.S. Cl. ..... 473/387; 473/396

[58] Field of Search ..... 473/387, 386, 473/390, 391, 392, 393, 394, 396, 397, 398, 400, 401, 402, 132, 133; 401/49, 55; 15/424, 425, 427

[56] References Cited

U.S. PATENT DOCUMENTS

| | | | |
|---|---|---|---|
| D. 85,229 | 9/1931 | Cannon . | |
| 727,398 | 5/1903 | Mack . | |
| 1,224,922 | 5/1917 | Ziemer . | |
| 1,278,147 | 9/1918 | Hess . | |
| 1,522,544 | 1/1925 | Pryde . | |
| 1,573,911 | 2/1926 | Budrow . | |
| 1,588,038 | 6/1926 | Miller . | |
| 1,588,815 | 6/1926 | Sillcocks . | |
| 1,616,683 | 2/1927 | Eddy . | |
| 1,625,911 | 4/1927 | Richards . | |
| 1,655,751 | 1/1928 | Cody . | |
| 1,670,123 | 5/1928 | Ranseen . | |
| 1,679,579 | 8/1928 | Lundy . | |
| 1,730,046 | 10/1929 | Stow . | |
| 1,959,347 | 5/1934 | Czichos . | |
| 2,029,767 | 2/1936 | Eisenhauer . | |
| 2,391,392 | 12/1945 | Coffin . | |
| 2,470,817 | 5/1949 | Hendricks . | |
| 2,747,768 | 5/1956 | Raines . | |
| 3,273,890 | 9/1966 | Williams . | |
| 3,633,919 | 1/1972 | Liccardello . | |
| 4,516,773 | 5/1985 | Martin | 473/406 |
| 4,516,780 | 5/1985 | Tabet . | |
| 4,893,818 | 1/1990 | Liccardello | 473/406 |
| 5,149,088 | 9/1992 | O'Hara . | |

FOREIGN PATENT DOCUMENTS

| | | |
|---|---|---|
| 238599 | 5/1924 | United Kingdom . |
| 267820 | 3/1927 | United Kingdom . |
| 326915 | 3/1930 | United Kingdom . |
| 427478 | 4/1935 | United Kingdom . |
| 525115 | 8/1940 | United Kingdom . |
| 2080121 | 2/1982 | United Kingdom . |
| 2227416 | 8/1990 | United Kingdom . |

*Primary Examiner*—Steven B. Wong
*Attorney, Agent, or Firm*—Brinks Hofer Gilson & Lione

[57] ABSTRACT

The invention provides a golf tee (10) having a head portion (2) and a shaft portion (1). Head portion (2) is adjustable in relation to the shaft portion (1) to vary the length of the tee (10), for example, by having head portion (2) include a sleeve mounted on an extension (3) and adapted to assume a plurality of positions in relation to the shaft portion (1). Tee (10) also includes a writing point (8) and an eraser (11).

10 Claims, 4 Drawing Sheets

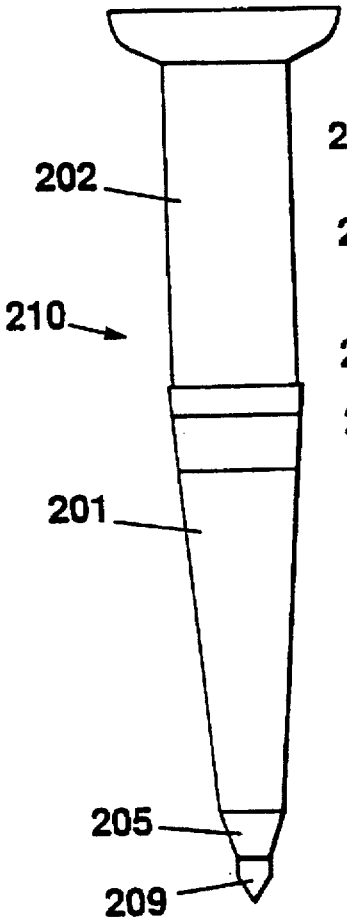
FIG. 7
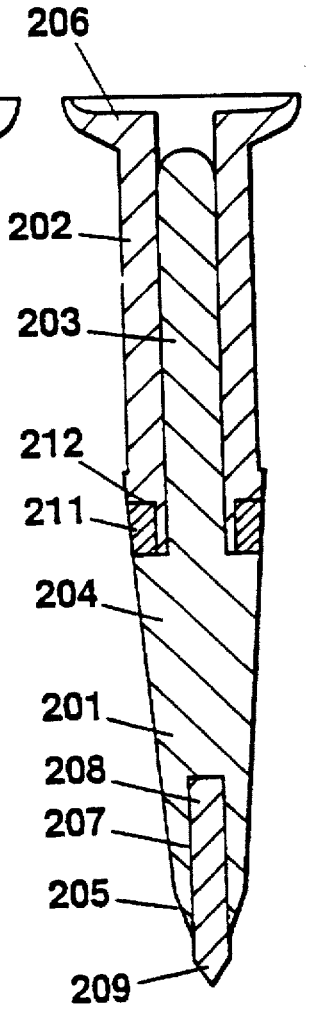
FIG. 8
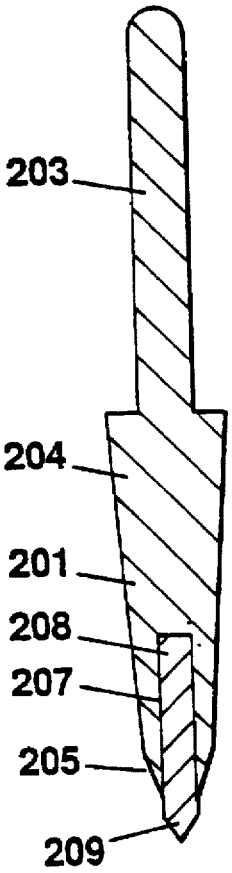
FIG. 9
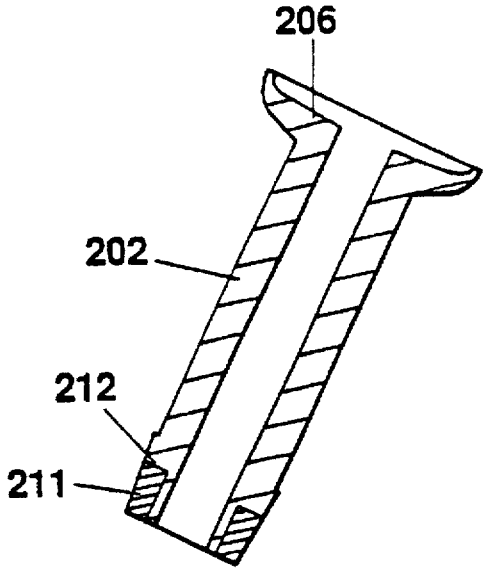

ADJUSTABLE HEIGHT GOLF TEE

TECHNICAL FIELD

This invention relates to a sporting apparatus useful in connection with the game of golf. More particularly this invention relates to an adjustable height golf tee.

BACKGROUND ART

During golf play, it is permissible to use a golf tee—usually a small wooden or plastic peg—to hold a golf ball in an elevated position before striking it with a golf club. The rules of golf normally provide for the use of a golf tee in this manner for the first stroke of each hole.

When playing a tee shot, the player has the option of using a club known as a "wood" or driver, which has a hitting face approaching the vertical, or an iron, which has a more inclined hitting face. A driver is considered more difficult to use and most players prefer to tee the ball in a high position when using a driver. However, when using an iron, many players will "sky" the ball if the tee is in a high position and consequently for tee shots using an iron it is the common practice to push the tee further into the ground so that the ball is teed in a low position.

There are practical difficulties encountered during these procedures. Often, the ground is so compacted or cold that the tee cannot be driven into the ground sufficiently to permit the tee to assume the "low" position. Attempts to force the tee into the ground can break the tee. Even if the tee can be driven into the ground to the desired extent, it is often broken if hit by the iron club, whereas if the tee had been higher, club contact may only lift the tee out of the ground and displace it.

In addition, an average size tee is often too short to achieve the desired "high" position. Some players find it necessary to carry two types of tee: the average size tee for iron shots and extra long tees for use with a driver.

It is an object of this invention to overcome or at least alleviate the difficulties described above, by providing a tee which can be used for both "high" and "low" shots.

The appearance and manufacture of conventional golf tees is well known. The conventional tee has a (usually concave) head, on which a golf ball may be supported, and a shaft, usually ending in a point, to enable the tee to be driven into the ground.

This invention provides a golf tee having a head portion and a shaft portion, characterised in that the head portion is adjustable in relation to the shaft portion to vary the length of the tee, and further characterised in that the tee includes a writing point and/or an eraser.

Preferably, the head portion of the tee includes a sleeve adapted to assume a plurality of positions in relation to the shaft portion. The sleeve may be mounted on the shaft or on an extension of the shaft and movable thereon by any suitable means. For example, the sleeve may be screw-threaded on an extension of the shaft provided for that purpose. Other arrangements may also be suitable, for example, the so-called "multi-start" configuration, or a friction-fit, optionally including a stop for each position of the sleeve on the shaft extension.

The means for adjusting the head portion in relation to the shaft portion are not limited to a sleeve as described. Other constructions will be apparent to one skilled in the art and are within the scope of this invention.

The tee of the invention may be manufactured from any suitable material. Moulded plastic is preferred, but wood or metal, including common metals and even silver and gold, may be used in the manufacture of the golf tee of the present invention.

The tee of the present invention includes a writing point and/or an eraser. Preferably, the tee of the invention includes both a writing point and an eraser. These features may take the form described in International Patent Application No. PCT/AU93/00042, the contents of which are imported herein by reference.

When the tee of the present invention includes an eraser and a sleeve, in one preferred embodiment, the eraser is located near the head of the tee. The sleeve is adapted to assume three positions in relation to the shaft portion: a first position wherein the eraser, located near the head, is exposed for easy use; a second position wherein the tee can be used as a "low" tee for iron shots; and a third position wherein the tee can be used as a "high" tee for driver shots.

In another embodiment, the sleeve may assume various positions between the second and third positions described and may even be removed entirely.

In yet another embodiment, the eraser may be located in another position, such as at the base of the sleeve.

BRIEF DESCRIPTION OF THE DRAWINGS

Preferred embodiments of the invention will now be described by way of example, with reference to the accompanying Drawings, in which:

FIG. 7 shows is a side elevation of yet a further embodiment of the tee of the invention;

FIG. 8 is a vertical cross-section of the tee of FIG. 7 with the sleeve in the second position;

FIG. 9 illustrates the tee of FIG. 7 with the sleeve removed to enable the free use of the eraser.

Figure 1:
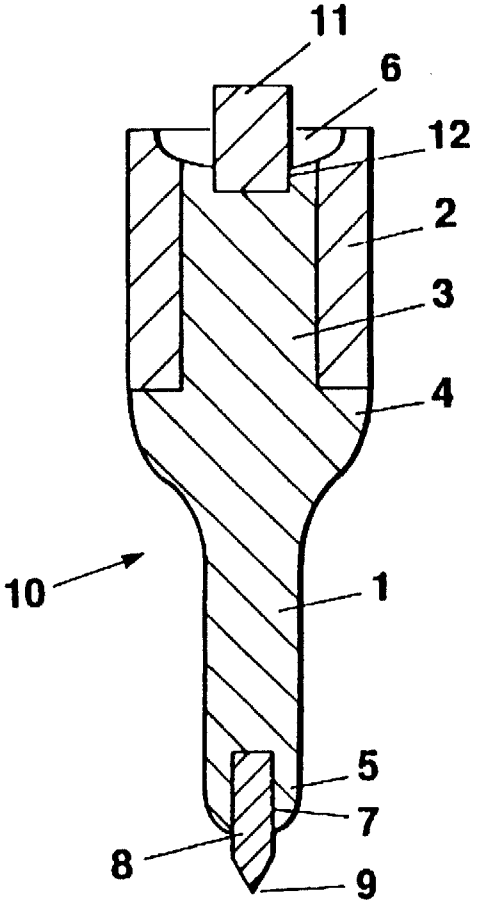
FIG. 1 is a cross-sectional view of a first embodiment of the tee of the invention showing the sleeve in the first position.

Referring first to FIG. 1, golf tee 10 has shaft portion 1 moulded in one piece and head portion 2 mounted on an extension 3 of shaft portion 1. Extension 3 is of smaller diameter than body 4 of shaft portion 1. Shaft portion 1 tapers from body 4 to point 5. Shaft portion 1 may, of course, be moulded in two or more pieces.

Head portion 2 takes the form of a sleeve which defines a hollow depression 6 to provide a concave surface for supposing a golf ball (not shown). Sleeve 2 is mounted on extension 3 by suitable means such as a friction fit.

Sleeve 2 may carry on its external surface advertising or informational material. For the purpose of printing on sleeve 2, it is particularly convenient that sleeve 2 is separate from shaft portion 1.

Formed in shaft portion 1 is cylindrical bore 7 which extends axially in shaft portion 1 from point 5 towards body 4. Writing point 8 consists of a pencil lead tapering towards its free end 9 and is mounted in bore 7 and held therein by friction, adhesive or any other suitable means.

Eraser 11 is mounted in bore 12 in extension 3 and bonded thereto or provided with a friction fit. In FIG. 1, sleeve 2 is in its lowermost position and exposes eraser 11 for use.

Figure 2:
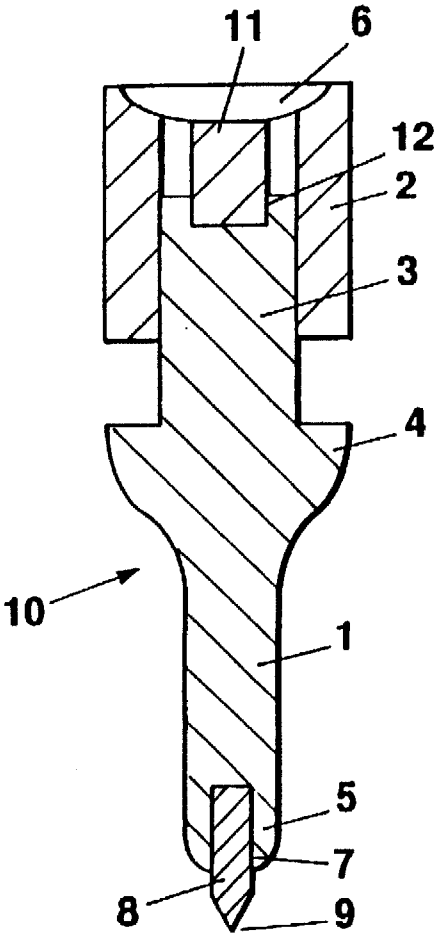
FIG. 2 shows the tee of FIG. 1 with the sleeve in the second position.

In FIG. 2, sleeve 2 is raised to an intermediate position. In this form, tee 10 may be used for iron shots.

Figure 3:
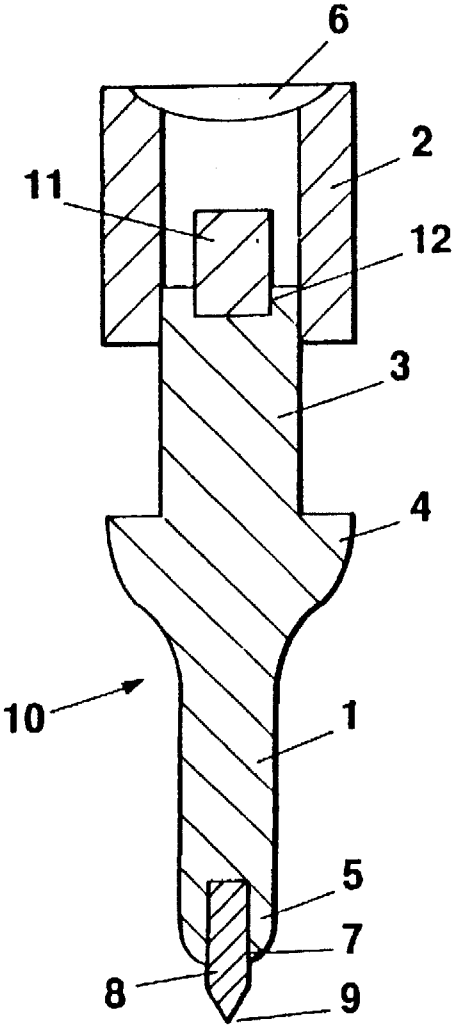
FIG. 3 illustrates the tee of FIG. 1 with the sleeve in the third position.

In FIG. 3, sleeve 2 is raised to its highest position. In this form, tee 10 is useful for driver shots.

Sleeve 2 may be adjusted quickly and easily to assume any of the three positions illustrated. Thus, during play, tee 10 can be adjusted between one tee shot and the next to suit the player's requirements.

When golf tee 10 is used as a tee, (see FIGS. 2 and 3) it may be inserted in the ground, using free end 9 to assist in penetrating the ground. A golf ball may then be placed on hollow depression 6 and hit therefrom in the usual manner. Tee 10 may then be recovered from the ground, and, by holding tee 10 as a pencil, point 8 may be used to mark the stroke on a score card, or to note other information, if desired.

It is within the scope of this invention that tee 10 has retractable writing means instead of point 8, as described in more detail in International Patent Application PCT/AU93/00042.

Figure 4:
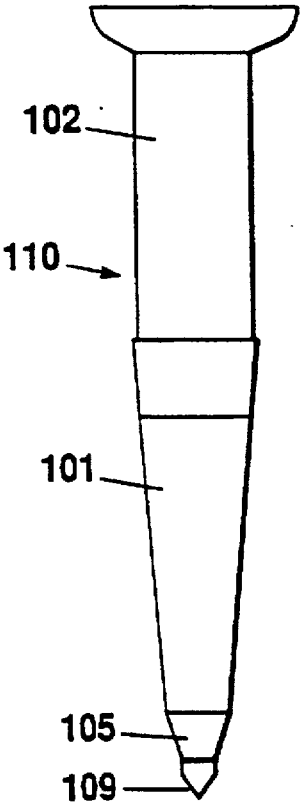
FIG. 4 is a side elevation of a second embodiment of the tee of the invention.
Figure 5:
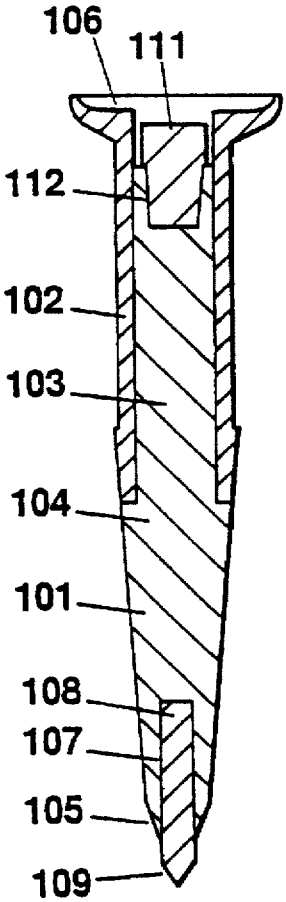
FIG. 5 is a vertical cross-section the tee of FIG. 4 with the sleeve in the second position.
Figure 6:
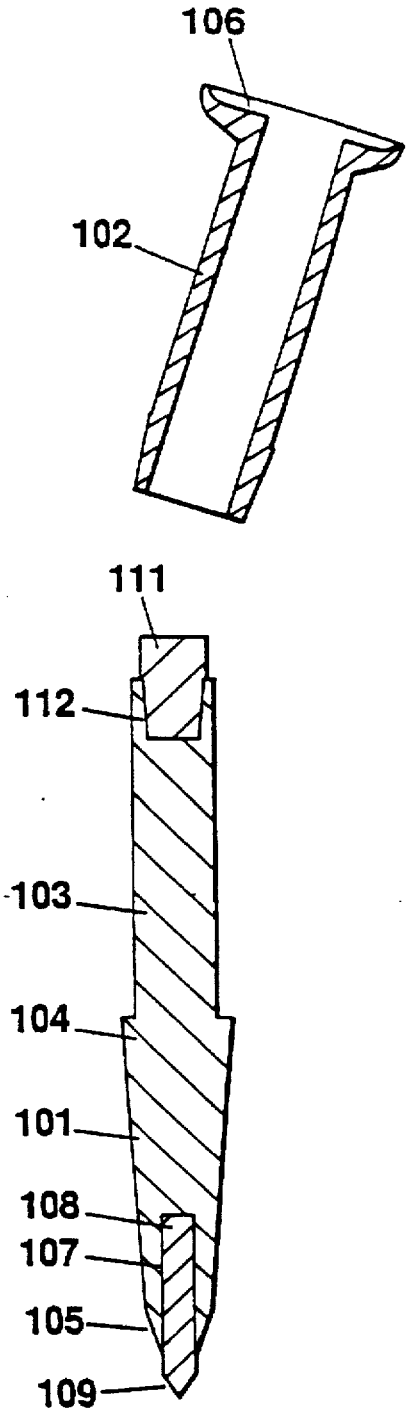
FIG. 6 illustrates the tee of FIG. 4 with the sleeve removed entirely to expose the eraser, i.e., in the first position.

Referring now to FIGS. 4 to 6, golf tee 110 is similar to tee 10, but of a different shape, having shaft portion 101 moulded in one piece and head portion 102 mounted on an extension 103 of shaft portion 101. Extension 103 is of smaller diameter than body 104 of shaft portion 101. Shaft portion 101 tapers from body 104 to point 105. Shaft portion 101 may, of course, be moulded in two or more pieces.

Head portion 102 takes the form of a sleeve which defines a hollow depression 106 to provide a concave surface for supporting a golf ball (not shown). Sleeve 102 is mounted on extension 103 so that there is a close friction fit therebetween.

Sleeve 102 may carry on its external surface advertising or informational material. To more effectively display advertising or informational material on sleeve 102, sleeve 102 is of constant cross-section throughout most of its length.

Formed in shaft portion 101 is cylindrical bore 107 which extends axially in shaft portion 101 from point 105 towards body 104. Writing point 108 consists of a pencil lead tapering towards its free end 109 and is mounted in bore 107 and held therein by friction, adhesive or any other suitable means.

Eraser 111 is mounted in bore 112 in extension 103 and bonded thereto or provided with a friction fit. In FIG. 6, sleeve 102 has been removed from extension 103 and exposes eraser 111 for use.

As will be appreciated by one skilled in the art, sleeve 102 may be positioned on extension 103 so as to vary the height of tee 110 to a desired extent, by raising sleeve 102 on extension 103, the friction fit between the two ensuring that sleeve 102 remains in the desired position. In this manner, the height of tee 110 is finely adjustable.

Turning now to FIGS. 7 to 9, golf tee 210 is similar to golf tee 110 in that golf tee 210 has shaft portion 201 moulded in one piece and head portion 202 mounted on an extension 203 of shaft portion 201. Extension 203 is of smaller diameter than body 204 of shaft portion 201. Shaft portion 201 tapers from body 204 to point 205. Once again, shaft portion 201 may be moulded in two or more pieces.

Sleeve 202 defines a hollow depression 206 to provide a concave surface for supporting a golf ball (not shown). Sleeve 202 is mounted on extension 203 so that there is a close friction fit therebetween. Sleeve 202 can carry on its external surface advertising or informational material, as in the case of sleeve 102.

Cylindrical bore 207 extends axially in shaft portion 201 from point 205 towards body 204. Writing point 208 consists of a pencil lead tapering towards its free end 209 and is mounted in bore 207 and held therein by friction, adhesive or any other suitable means.

In this embodiment, eraser 211 is mounted in recess 212 in sleeve 202 and bonded thereto or provided with a friction fit. In FIG. 9, sleeve 202 has been removed from extension 203 and exposes eraser 211 for use by manipulation of sleeve 202.

As in the case of sleeve 102, sleeve 202 may be positioned on extension 203 so as to vary the height of tee 210 to a desired extent.

Figure 10:
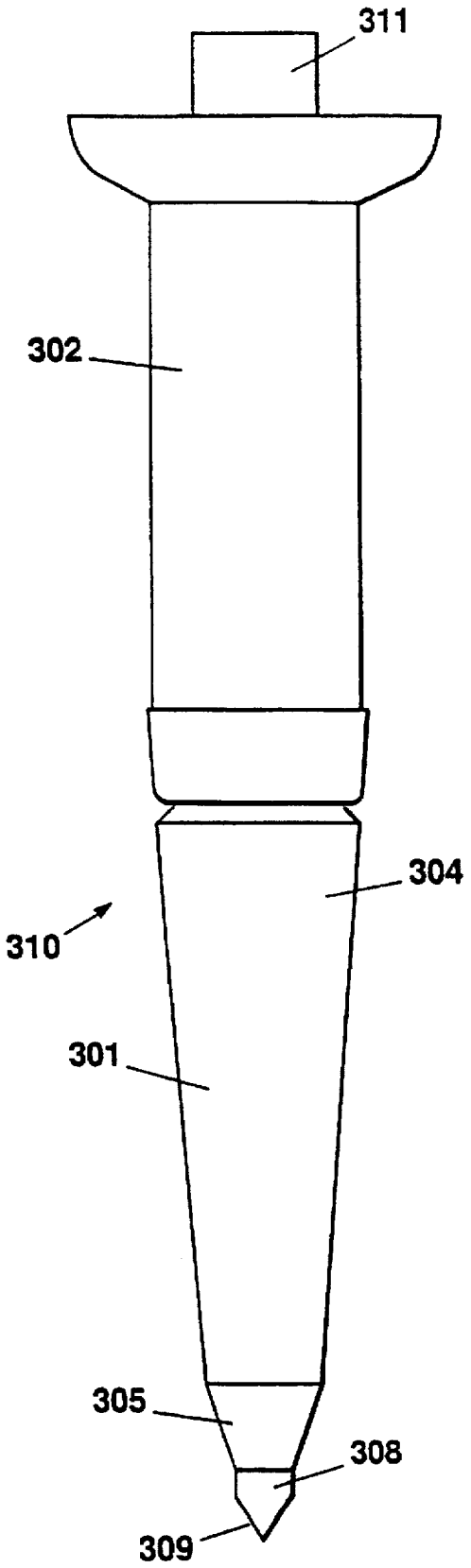
FIGS. 10 and 11 show a tee similar to that in FIGS. 1 to 3 but having a screw threaded mounting, FIG. 11 being a cross-sectional view of the tee in FIG. 10.
Figure 11:
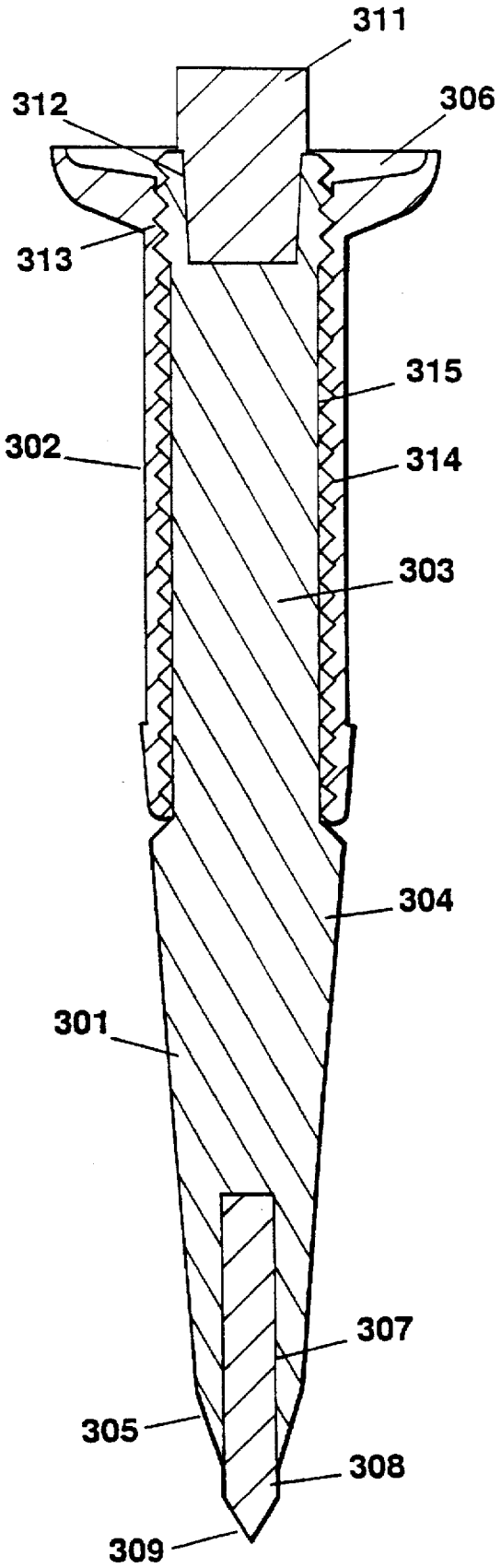

The tee in FIGS. 10 and 11 is similar to that in FIGS. 1 to 3. Golf tee 310 has shaft portion 301 moulded in one piece and head portion 302 mounted on an extension 303 of shaft portion 301. Extension 303 is of smaller diameter than body 304 of shaft portion 301. Shaft portion 301 tapers from body 304 to point 305.

Sleeve 302 defines a hollow depression 306 to provide a concave surface for supporting a golf ball (not shown). Sleeve 302 is mounted on extension 303 via an internal screw thread 314 mating with a complementary external thread 313 on extension 303. Thread 313 is restricted to the upper part of extension 303, so that the rest of the external surface 315 of extension 303 is smooth. Rotation of sleeve 302 enables sleeve 302 to be positioned on extension 303 so as to vary the height of tee 310 to a desired extent.

Cylindrical bore 307 extends axially in shaft portion 301 from point 305 towards body 304. Writing point 308 consists of a pencil lead tapering towards its free end 309 and is mounted in bore 307 and held therein by friction, adhesive or any other suitable means.

In this embodiment, eraser 311 is mounted in bore 312 in extension 303 and bonded thereto or provided with a friction fit.

It will be appreciated that although the above embodiments include a writing point and an eraser in the tee of the invention, it is within the scope of the invention that the writing point or the eraser may be omitted.

INDUSTRIAL APPLICABILITY

It will be appreciated that the golf tee of the invention represents a significant advancement over the prior art. The invention provides a neat and convenient solution to the problems faced by the prior art, in enabling a single golf tee to be adjusted to suit different uses, and in also providing a writing point and/or an eraser.

I claim:

1. A golf tee for adjustably positioning the height of a golf ball, the golf tee comprising:

a shaft having a first end and a second end;

a writing point positioned at the first end;

an eraser positioned in a recessed area on the second end;

the shaft having an upper portion and a lower portion, wherein the upper portion has a constant diameter; and a hollow sleeve having first and second open ends, the sleeve sized to fit around the upper portion of the shaft, the first open end of the sleeve defining a concave area for receiving a golf ball.

2. The golf tee of claim 1 wherein the concave area on the first open end of the sleeve is completely removable from the shaft and the eraser is accessible when the sleeve is removed.

3. The golf tee of claim 1, wherein the sleeve has an internal screw-thread adapted to mate with an external screw-thread on the upper portion of the shaft.

4. The golf tee of claim 1, wherein the sleeve is friction-fitted to the upper portion of the shaft.

5. A golf tee being adjustable in height between a position of maximum height and a position of minimum height, the golf tee comprising:

a shaft having a first and a second end;

a writing point positioned at the first end;

the shaft having an upper portion and a lower portion;

a hollow sleeve having first and second open ends, the sleeve being sized to fit around the upper portion of the shaft, the first open end of the sleeve defining a concave area for receiving a golf ball; and an eraser positioned on the golf tee so as to be inaccessible when the golf tee is adjusted to the position of maximum height.

6. The tee as claimed in claim 5, wherein the sleeve is friction-fitted to the upper portion of the shaft.

7. The tee claimed in claim 5, wherein the sleeve has an internal screw-thread adapted to mate with an external screw-thread on the upper portion of the shaft.

8. The tee claimed in claim 5, wherein the sleeve is complete removable from the shaft.

9. The tee claimed in claim 5, wherein the eraser is positioned in a recessed area on the second end of the shaft.

10. The tee claimed in claim 5, wherein the eraser is positioned at the second open end of the hollow sleeve.

* * * * *